US008936504B2

(12) United States Patent
Deal et al.

(10) Patent No.: US 8,936,504 B2
(45) Date of Patent: Jan. 20, 2015

(54) BACKLESS STRAPLESS BRA HAVING REMOVABLE SIDE EXTENSIONS

(76) Inventors: Beverly Ann Deal, Ventura, CA (US); Rebecca Harmon, Ventura, CA (US); Chih Jung Lee, Ventura, CA (US); Judy Lee, Ventura, CA (US)

( * ) Notice: Subject to any disclaimer, the term of this patent is extended or adjusted under 35 U.S.C. 154(b) by 0 days.

(21) Appl. No.: 13/261,187

(22) PCT Filed: Jul. 5, 2011

(86) PCT No.: PCT/US2011/001185

§ 371 (c)(1), (2), (4) Date: Feb. 22, 2012

(87) PCT Pub. No.: WO2012/158139

PCT Pub. Date: Nov. 22, 2012

(65) Prior Publication Data

US 2014/0057528 A1 Feb. 27, 2014

Related U.S. Application Data

(63) Continuation-in-part of application No. 29/373,738, filed on May 17, 2011, now Pat. No. Des. 666,386.

(51) Int. Cl.
*A41C 3/06* (2006.01)
*A41C 3/00* (2006.01)

(52) U.S. Cl.
CPC ..... *A41C 3/065* (2013.01); *A41C 3/0078* (2013.01)
USPC ..... 450/81; 450/39

(58) Field of Classification Search
CPC ..... A41C 3/065; A41C 3/06; A41C 3/10; A41C 3/14; A41C 3/144
USPC ..... 450/37, 38, 39, 54–57, 81, 86, 88
See application file for complete search history.

(56) References Cited

U.S. PATENT DOCUMENTS

| | | | | |
|---|---|---|---|---|
| 6,231,424 | B1 * | 5/2001 | Valentin | 450/81 |
| 6,257,952 | B1 | 7/2001 | Valentin | |
| 6,336,839 | B1 * | 1/2002 | Valli | 450/1 |
| 6,371,831 | B1 * | 4/2002 | Dodge | 450/81 |
| 6,383,055 | B2 * | 5/2002 | Valentin | 450/81 |
| 6,780,081 | B2 | 8/2004 | Chen et al. | |
| 6,814,648 | B2 * | 11/2004 | Chong | 450/81 |
| 6,852,001 | B2 | 2/2005 | Chen et al. | |
| 6,916,224 | B2 | 7/2005 | Chen et al. | |
| 7,052,359 | B2 | 5/2006 | Chen et al. | |
| 7,335,086 | B1 | 2/2008 | Karon | |
| 7,677,952 | B2 * | 3/2010 | Wooley | 450/81 |
| 2009/0093190 | A1 * | 4/2009 | Wooley | 450/41 |
| 2009/0227181 | A1 | 9/2009 | Chen | |
| 2009/0298386 | A1 | 12/2009 | Deal et al. | |
| 2011/0171880 | A1 * | 7/2011 | Nam | 450/81 |
| 2011/0256801 | A1 * | 10/2011 | Cho | 450/39 |
| 2012/0108143 | A1 * | 5/2012 | Sherwood | 450/57 |
| 2012/0266348 | A1 * | 10/2012 | Meginnis | 2/69 |
| 2013/0065729 | A1 * | 3/2013 | Fitzgerald | 477/8 |

* cited by examiner

*Primary Examiner* — Gloria Hale

(74) *Attorney, Agent, or Firm* — Arthur Freilich

(57) ABSTRACT

A backless strapless bra comprised of a sheet of thermoplastic material having a left edge portion and a right edge portion and left and right breast cups molded into the sheet. Adhesive material is provided on the inner surface of the sheet for removably adhering the sheet to the front of a user's body so as to accommodate the user's breasts in said breast cups. Optional left and right extension strips are provided configured to be removably adhered to the left and right sheet edge portions and to the sides of the user's body.

10 Claims, 5 Drawing Sheets

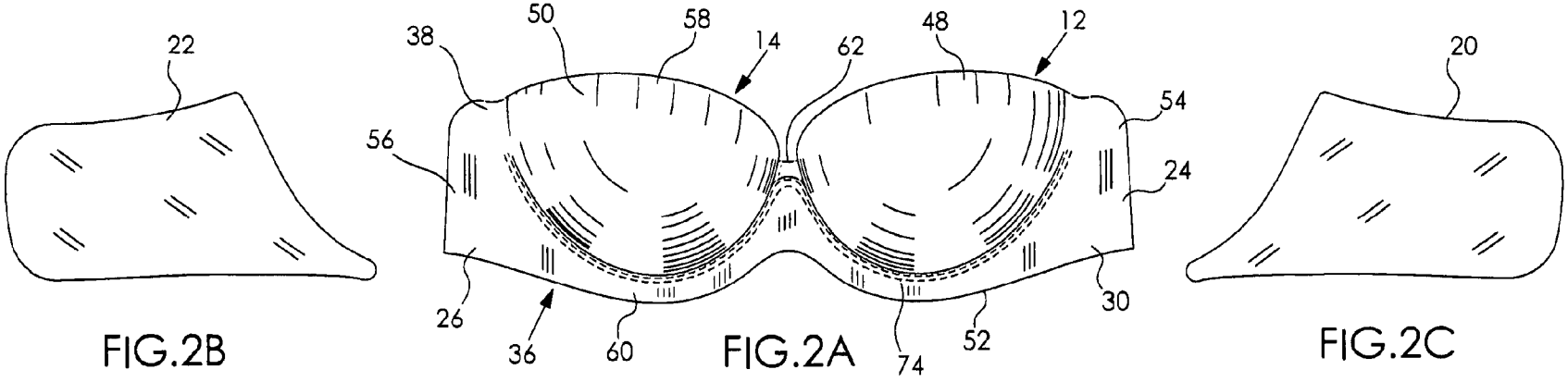
FIG.2C
FIG.2A
FIG.2B
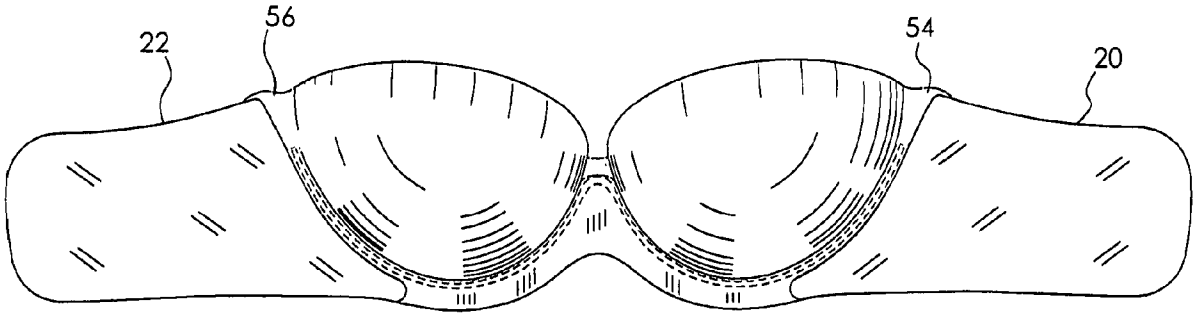
FIG.3

BACKLESS STRAPLESS BRA HAVING REMOVABLE SIDE EXTENSIONS

FIELD OF THE INVENTION

This invention relates to backless strapless bras.

BACKGROUND OF THE INVENTION

The prior art is replete with various backless strapless bra constructions as exemplified by the following patents and the references cited therein:

U.S. Pat. No. 7,335,086
U.S. Pat. No. 6,780,081
U.S. Pat. No. 6,231,424
U.S. Pat. No. 6,257,952
U.S. Pat. No. 6,383,055

Many of the known backless strapless bras use a reusable pressure sensitive adhesive for removebly adhering the bra to a user's body. The adhesive can be applied to the inner side of the breast cups and/or the inner side of the bra structure surrounding the breast cups, including laterally extending side panels. For example, as described in U.S. Pat. No. 7,335,086, When the brassiere 100 is worn, each side panel 120, 122 extends to a lateral side (i.e., left or right side) of the body of the wearer. Each side panel 120, 122 provides an additional surface area of the brassiere 100 that is adhered to the body of the wearer using an adhesive, thereby providing supplementary support for the breasts of the wearer.

SUMMARY OF THE INVENTION

The present invention is directed to a backless strapless bra characterized by a main bra structure and optional side extensions configured to removebly adhere to both the main bra structure and the user's body.

A preferred main bra structure in accordance with the invention comprises a sheet of substantially planar material molded to form left and right breast cups. The sheet has inner and outer surfaces and is bounded by a periphery enclosing left and right edge portions and top and bottom edge portions.

A preferred bra planar sheet in accordance with the invention is formed of first and second thermoplastic films fused at their edges to envelop an interior volume. The interior volume is preferably filled with liquid silicone and the composite sheet structure so formed is molded to form the aforementioned breast cups.

A preferred main bra structure in accordance with the invention includes a support wire retained in said interior volume so as to extend under said breast cups.

The aforementioned optional side extensions preferably comprise left and right planar strips, each having an inner surface and an outer surface. The inner surfaces of said left and right extension strips preferably carry reusable pressure sensitive adhesive for removably adhering said strips to the main bra structure so as to extend laterally to enable the strips to also be adhered to the sides of a user's body.

BRIEF DESCRIPTION OF THE DRAWINGS

FIG. 2A is a front plan view of the bra structure of FIG. 1A;

FIGS. 2B and 2C are front plan views of right and left side extensions;

FIG. 3 is a front plan view of the bra structure of FIG. 2A with the side extensions of FIGS. 2B and 2C applied thereto;

DETAILED DESCRIPTION

Figure 1A:
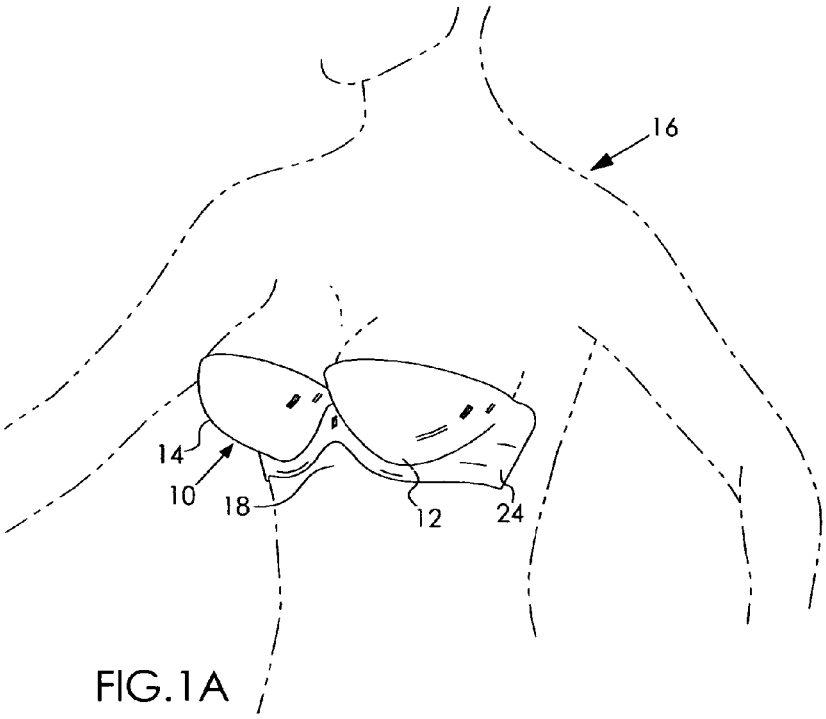
FIG. 1A is an isometric view of a preferred bra structure in accordance with the invention.

Attention is initially directed to FIG. 1A which depicts a backless strapless bra 10 in accordance with the invention having left and right cups 12, 14 for supporting the respective breasts of a user 16. As will be described hereinafter, the inner surface of the bra 10 carries reusable pressure sensitive adhesive for adhering the bra to the body 18 of the user 16.

Figure 1B:
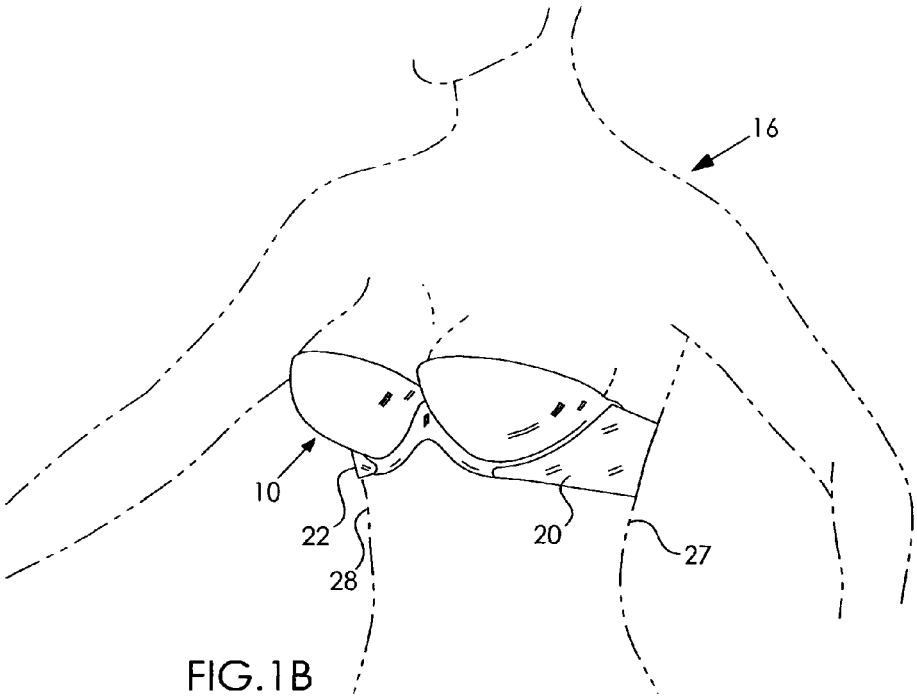
FIG. 1B is an isometric view of the structure of FIG. 1A with the optional side extensions applied.

FIG. 1B depicts the bra 10 of FIG. 1A together with left and right side extension strips 20, 22 which can be optionally used to provide better support for the bra 10 and user's breasts. The strips 20, 22 are substantially planar and define an inner surface which carries reusable pressure sensitive adhesive for adhering respectively to the left and right side edge portions 24, 26 (FIG. 2A) of the bra 10 and additionally to the left and right sides 27, 28 of the user's torso.

Figure 4A:
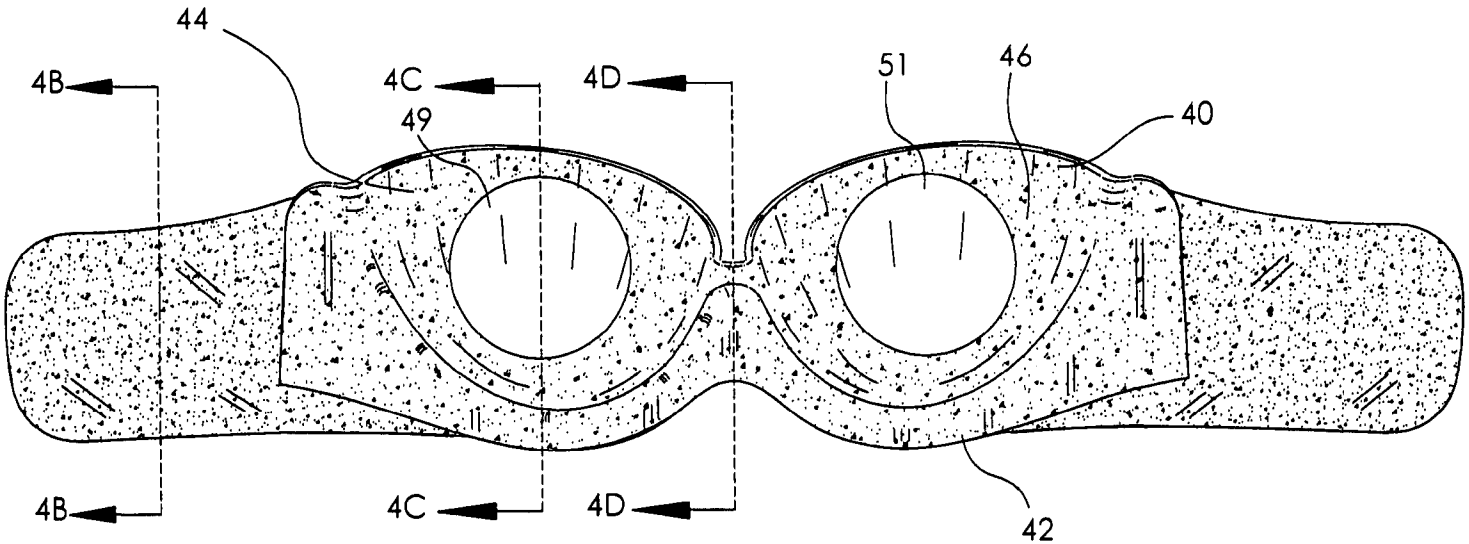
FIG. 4A is a rear plan view of the bra assembly of FIG. 3.
Figure 4D:
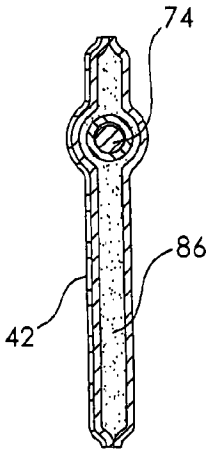
FIG. 4D is a sectional view taken substantially along the plane 4D-4D of FIG. 4A.
Figure 4C:
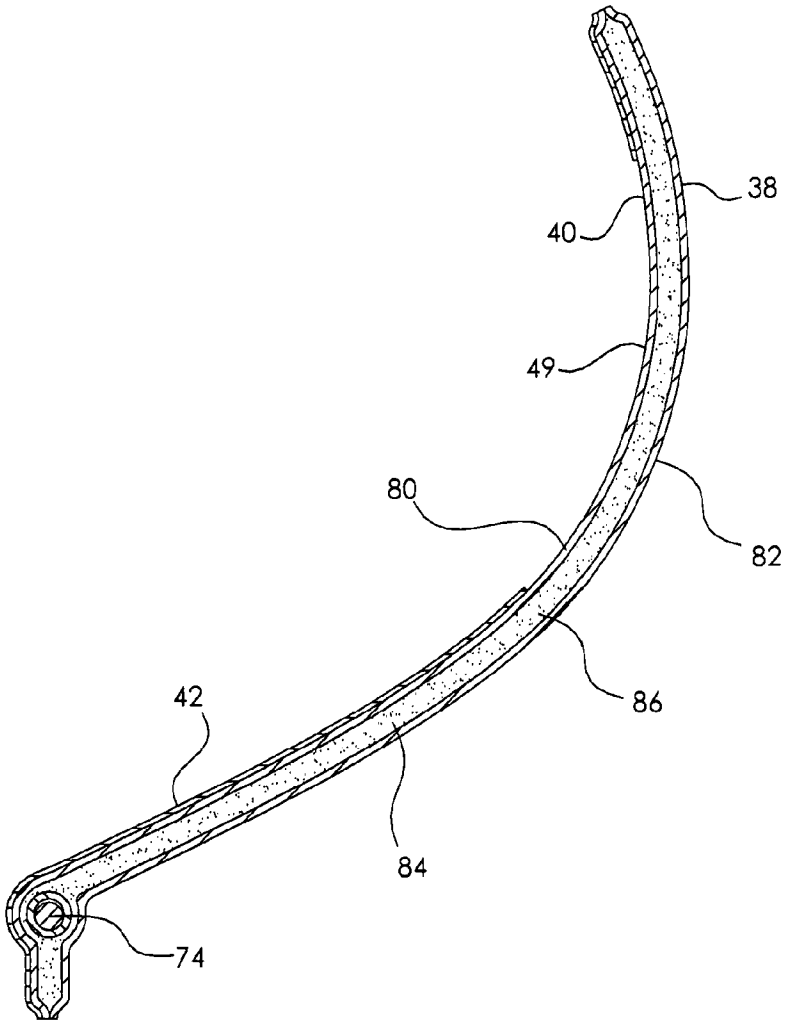
FIG. 4C is a sectional view taken substantially along the plane 4C-4C of FIG. 4A.

A preferred embodiment of the bra 10 is shown in FIGS. 2A, 2B, 2C, 3, 4A, 4B, 4C and 4D. The bra 10 is preferably formed of thermoplastic sheet material 30 molded to form the left and right breast cups 12, 14. FIG. 2A is a front plan view of a preferred bra structure 36 showing the bra outer surface 38. FIG. 4A is a rear plan view of the bra structure 36 showing the bra inner surface 40 covered by a reusable pressure sensitive adhesive 42. The thermoplastic sheet material 30 is preferably molded to create breast cups 12, 14 characterized by concave pockets 44, 46 at the bra inner surface 40 and protruding convex surfaces 48, 50 on the bra outer surface 38. The adhesive 42 extends onto the inner surfaces of the concave pockets 44, 46 but preferably the central nipple areas 49, 51 are devoid of adhesive for the comfort of the user.

The bra sheet material 30 is bounded by a periphery 52 enclosing a left edge portion 54, a right edge portion 56, a top edge portion 58, and a bottom edge portion 60. Note that the breast cups 12, 14 extend from the top edge portion 58 toward the bottom edge portion 60. Also note that the left breast cup 32 extends from the left edge portion 54 to a central bridge region 62. Similarly, the right breast cups 34 extends from the right edge portion 56 to the bridge region 62.

A user can wear the bra 10 of FIG. 2A without the side extension strips 20, 22 by relying solely on the reusable adhesive 42 on the bra inner surface 40 to secure the bra to the front of the user's body, as represented in FIG. 1A. However, to provide additional breast support and assure bra retention, many user's may prefer to additionally use the optional side extension strips 20, 22. The strips are configured to adhere to the bra edge portion outer surfaces and the sides of the user's torso.

FIG. 2A shows a front plan view of the bra 10 and FIGS. 2B, 2C respectively show the optional side extension strips

Figure 4B:
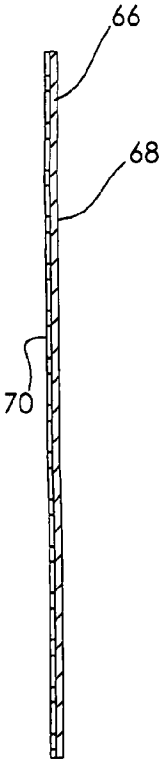
FIG. 4B is a sectional view taken substantially along the plane 4B-4B of FIG. 4A.

20, 22. The strips are essentially planar having inner and outer surfaces 66, 68 (FIG. 4B). A reusable pressure sensitive adhesive 70 is carried on the strip inner surface 66.

The strips 20, 22 are shaped and dimensioned to respectively layover and adhere to the outer surface of the left and right edge portions 54, 56 of the bra 10 as shown in FIG. 3. As shown in FIGS. 3 and 4A, the strips extend laterally from the edge portions 54, 56 for adhering to the sides 27, 28 of the user's body as shown in FIG. 1B.

A flexible wire 74 is preferably embedded in the sheet material 30 located to extend under and provide support for the breast cups 12, 14.

The aforementioned sheet material 30 used to mold bra 10 is preferably formed by first and second thermoplastic film layers 80, 82 whose edges are fused together to essentially form a bag enclosing an interior volume 84. A portion of the film edges is initially left open to allow for insertion of the aforementioned underwire 74 into the interior volume 84. The interior volume is then filled with liquid silicone 86 and the thermoplastic film edges are fully sealed to thus form a flat flexible sheet. The composite sheet thus formed is inserted into a mold to form the afordescribed breast cups 12, 14. After removal from the mold, the reusable pressure sensitive adhesive is applied to the formed bra structure.

Figure 5A:
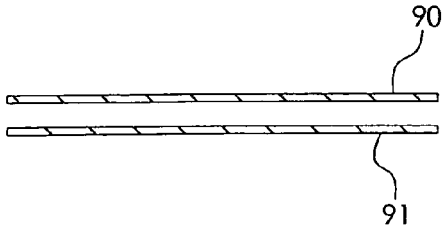
FIG. 5A-5C are schematic representations showing steps of a preferred method of fabricating the main bra structure of FIG. 1A.
Figure 5B:
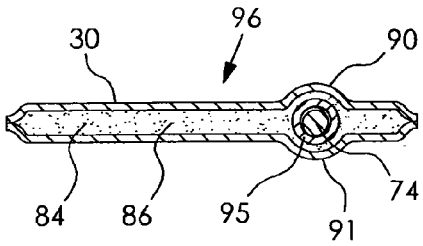
Figure 5C:
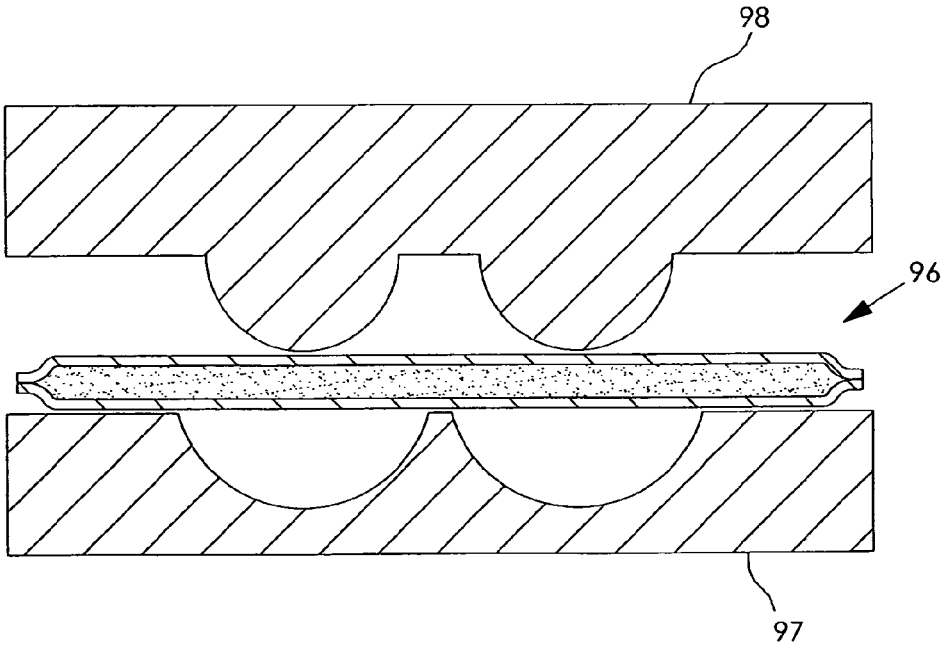

A preferred sequence of steps for fabricating the bra 10 is schematically depicted in FIGS. 5A-5C and includes the following:

1. Cut two sheets 90, 91 of thermoplastic polyurethane (TPU) film to size (FIG. 5A);
2. Insert wire 74 into a flexible silicone tube 95 and then bend to form concave arc;
3. Place wire/tube formed in step 2 between precut TPU films and seal edges to form flat bag 96 enclosing interior volume 84 (FIG. 5B);
4. Inject medical grade liquid silicone 86 into TPU bag created in Step 3, comprised for example of methyl polysiloxane 20~28%, viyl polysilozane 16~23%, poly methyl hydrogen siloxane 24~32%, silicone resin 36~45, and modified polysiloxane 2~10%;
5. Remove air bubbles from interior volume 84;
6. Final sealing of film edges with silicone and wire/tube sealed within interior volume 84 to form composite sheet material 30;
7. Place sealed flat bag 96, i.e., composite sheet 30, on female mold 97, e.g., aluminum, and then use suction to pull sheet into female mold 97 (FIG. 5C). Place male mold 98 on top and then clamp tight;
8. Place clamped mold with composite sheet therein onto conveyor belt and heat at 170° C. for approximately 18 minutes.
9. Remove formed bra from mold and trim excess TPU film
10. Clean formed bra with water and air dry.
11. Apply adhesive to inside surface of bra (avoiding nipple area) to 0.5 mm thick. Then heat to 90° C. for ten minutes.

From the forgoing, it should now be understood that Applicants have provided a backless strapless bra structure particularly configured to enable a user to wear the bra either with or without side extension strips and have described a preferred embodiment formed of molded thermoplastic sheet material. Although a particular preferred embodiment has been described, it should be understood that various modifications and alternatives will occur to those skilled in the art coming within the spirit of Applicants' invention and intended scope of the appended claims.

The invention claimed is:

1. A backless strapless bra comprising:

a sheet of substantially planar material bounded by a periphery enclosing a left edge portion, a right edge portion, a top edge portion, and a bottom edge portion;

said sheet being shaped to form left and right breast cups respectively located proximate to said left and right edge portions, each cup extending from said top edge portion toward said bottom edge portion;

said sheet defining an inner surface and an outer surface, and wherein the inner surface of each of said cups forms a concave pocket;

adhesive material on said sheet inner surface for removably adhering said sheet to the front of a user's body so as to accommodate the user's breasts in said concave pockets;

a left extension strip having an inner surface and an outer surface, and wherein said inner surface carries a pressure sensitive adhesive for removably adhering said left extension strip (1) to said sheet outer surface proximate to said left edge portion and (2) to said user's body laterally beyond said left edge portion; and a right extension strip having an inner surface and an outer surface and wherein said inner surface carries a pressure sensitive adhesive for removably adhering said right extension strip (1) to said sheet outer surface proximate to said left edge portion and (2) to said user's body laterally beyond said left edge portion.

2. The bra of claim 1 where said planar material is thermoplastic.

3. The bra of claim 1 wherein said planar material comprises substantially parallel first and second thermoplastic films enveloping an interior volume; and further including:

liquid silicone substantially filling said interior volume.

4. The bra of claim 3 further including wire portions retained in said interior volume extending under said breast cups.

5. The bra of claim 1 wherein the central area of the inner surface of each of said concave pockets is devoid of adhesive material.

6. A backless strapless bra comprising:

a sheet of planar material having inner and outer surfaces, left and right edge portions, and top and bottom edge portions, said sheet being formed to define left and right breast cups with the inner surface of each cup forming a concave pocket;

adhesive material on said sheet inner surface for removably adhering said sheet to the front of a user's body so as to accommodate the user's breasts in said concave pockets;

a left extension strip having a first end removably adhered to said left edge portion and a second end extending laterally beyond said left edge portion;

a right extension strip having a first end removably adhered to said right edge portion and a second end extending laterally beyond said right edge portion; and wherein each of said extension strips has an inner surface bearing an adhesive for removably adhering the extension strip to the torso of a user's body.

7. The bra of claim 6 wherein said planar material is thermoplastic; and wherein;

said breast cups are molded into said sheet.

8. The bra of claims 7 wherein said planar material comprises substantially parallel first and second thermoplastic films enveloping an interior volume; and further including;

liquid silicone substantially filling said interior volume.

9. The bra of claim 8 further including wire portions retained in said interior volume extending under said breast cups.

10. A backless strapless bra comprising:

a sheet of material having left and right edge portions and top and bottom edge portions;

said sheet defining left and right breast cups where each breast cup has an inner surface forming a concave pocket and wherein said sheet is configured for placement adjacent to the front of of a user's body so as to accommodate the user's breasts in said concave pockets;

a left extension strip having a first end removably adhered to said left edge portion and a second end extending laterally beyond said left edge portion;

a right extension strip having a first end removably adhered to said right edge portion and a second end extending laterally beyond said right edge portion; and wherein each of said extension strips has an inner surface bearing an adhesive for removably adhering the extension strip to the torso of a user's body.

* * * * *